US008577258B2

(12) United States Patent
Uehara et al.

(10) Patent No.: US 8,577,258 B2
(45) Date of Patent: Nov. 5, 2013

(54) IMAGE FORMING DEVICE HAVING REGULATING MEMBER CONFIGURED TO PROHIBIT MOVEMENT OF PHOTOSENSITIVE BODY IN LOCK STATE

(75) Inventors: Junji Uehara, Inazawa (JP); Kyoko Tsutsui, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 221 days.

(21) Appl. No.: 12/984,903

(22) Filed: Jan. 5, 2011

(65) Prior Publication Data

US 2011/0217075 A1 Sep. 8, 2011

(30) Foreign Application Priority Data

Mar. 8, 2010 (JP) ..... 2010-050589

(51) Int. Cl.
*G03G 15/00* (2006.01)
*G03G 21/18* (2006.01)

(52) U.S. Cl.
USPC ..... 399/117; 399/114

(58) Field of Classification Search
USPC ..... 399/114, 117, 167, 119
See application file for complete search history.

(56) References Cited

U.S. PATENT DOCUMENTS

| | | | | |
|---|---|---|---|---|
| 6,895,199 | B2 | 5/2005 | Sato et al. | |
| 7,266,327 | B2 | 9/2007 | Mori et al. | |
| 8,068,767 | B2 | 11/2011 | Kamimura et al. | |
| 2002/0131790 | A1 | 9/2002 | Sato et al. | |
| 2004/0265002 | A1 * | 12/2004 | Tsusaka | 399/124 |
| 2005/0008394 | A1 | 1/2005 | Ishii et al. | |
| 2005/0025521 | A1 | 2/2005 | Mori et al. | |
| 2009/0169253 | A1 * | 7/2009 | Kamimura et al. | 399/117 |
| 2009/0304412 | A1 | 12/2009 | Hattori et al. | |

FOREIGN PATENT DOCUMENTS

| | | | |
|---|---|---|---|
| CN | 2781422 | Y | 5/2006 |
| JP | 2002-278415 | | 9/2002 |
| JP | 2005-017914 | | 1/2005 |
| JP | 2005-031214 | | 2/2005 |
| JP | 2005-043822 | | 2/2005 |
| JP | 2005043822 | A * | 2/2005 |
| JP | 2009-162913 | | 7/2009 |
| JP | 2009-162914 | | 7/2009 |

OTHER PUBLICATIONS

Office Action for corresponding Japanese Patent Application 2010-050589 mailed Jan. 31, 2012.
European Search Report issued in corresponding European Patent Application 10015396.4 mailed Apr. 16, 2012.
Office Action issued in corresponding Chinese Patent Application No. 201110063986.3 mailed May 28, 2013.

* cited by examiner

*Primary Examiner* — Billy J Lactaoen
(74) *Attorney, Agent, or Firm* — Banner & Witcoff, Ltd.

(57) ABSTRACT

A positioning guide is configured to guide a rotational axis of a photosensitive body when a process cartridge is mounted on a main body, and to determine a position of the rotation axis of the photosensitive body with respect to the main body in a mounting state in which the process cartridge has been mounted on the main body. A photosensitive body drive gear is configured to be capable of rotating in a forward and reverse direction and to transmit a rotational drive force to the photosensitive body in the mounting state. A regulating member is configured to be in a lock state and an unlock state. In the lock state, the regulating member prohibits the rotational axis of the photosensitive body from moving in the mounting/removing direction. The rotational axis of the photosensitive body is released from the regulating member in the unlock state.

6 Claims, 14 Drawing Sheets

IMAGE FORMING DEVICE HAVING REGULATING MEMBER CONFIGURED TO PROHIBIT MOVEMENT OF PHOTOSENSITIVE BODY IN LOCK STATE

CROSS REFERENCE TO RELATED APPLICATION

This application claims priority from Japanese Patent Application No. 2010-050589 filed Mar. 8, 2010. The entire content of the priority application is incorporated herein by reference.

TECHNICAL FIELD

The present invention relates to an image forming apparatus that forms an image on a recording sheet.

BACKGROUND

A conventional image forming apparatus is configured such that, upon occurrence of paper jam in a roller for conveying a recording sheet (conveying roller), a drive motor is driven in a reverse rotation to drive each gears of gear transmission mechanism in the reverse rotation, and thereby separating a middle gear (planetary gear) from a gear at a position downstream thereof (idle gear) to cut off transmission of a driving force. With this configuration, the conveying roller can be freely rotated after the drive motor has been driven in the reverse rotation. Hence, the paper jam can be easily resolved.

SUMMARY

However, in the image forming apparatus described above, when the drive motor is driven in the reverse rotation, a gear (photosensitive member driving gear) for transmitting the rotational driving force to a photosensitive drum (photosensitive member) is also driven in the reverse rotation. At this time, in such a configuration that the photosensitive member is provided in a process cartridge detachably mounted in a main body, a force acts on the photosensitive member in a removing direction of the photosensitive member from the main body. Hence, displacement of the photosensitive member may occur.

In view of the foregoing, it is an object of the present invention to provide an image forming apparatus capable of preventing displacement of a photosensitive member when a photosensitive member driving gear is driven in a reverse rotation.

In order to attain the above and other objects, the present invention provides an image forming apparatus including a main body, a process cartridge, a positioning guide, a photosensitive body, and a regulating member. The process cartridge is detachably mounted on the main body in a mounting/removing direction and rotatably supports a photosensitive body about a rotational axis. The positioning guide is configured to guide the rotational axis of the photosensitive body when the process cartridge is mounted on the main body, and to determine a position of the rotation axis of the photosensitive body with respect to the main body in a mounting state in which the process cartridge has been mounted on the main body. The photosensitive body drive gear is configured to be capable of rotating in a forward and reverse direction and to transmit a rotational drive force to the photosensitive body in the mounting state. The regulating member is configured to be in a lock state and an unlock state. In the lock state, the regulating member prohibits the rotational axis of the photosensitive body from moving in the mounting/removing direction. The rotational axis of the photosensitive body is released from the regulating member in the unlock state.

BRIEF DESCRIPTION OF THE DRAWINGS

The particular features and advantages of the invention as well as other objects will become apparent from the following description taken in connection with the accompanying drawings, in which:

FIGS. 5A, 5B, 5C and 5D are explanatory views for showing an schematic configuration of an output coupling and explaining an operation thereof, wherein FIG. 5A shows the output coupling in a retracted state as viewed from an outer side of the left frame, FIG. 5B shows the output coupling in the retracted state as viewed from an inner side of the left frame, FIG. 5C shows the output coupling in a protruding state as viewed from the outer side of the left frame, and FIG. 5D shows the output coupling in the protruding state as viewed from the inner side of the left frame;

DETAILED DESCRIPTION

A laser printer 1 as an image forming apparatus according to one embodiment of the present invention will be described while referring to the accompanying drawings.

The terms "above", "below", "right", "left", "front", "rear" and the like will be used throughout the description assuming that the image forming apparatus is disposed in an orientation in which it is intended to be used. More specifically, in FIG. 1, a left side and a right side are a front side and a rear side, respectively.

<General Structure of Laser Printer>

Figure 1:
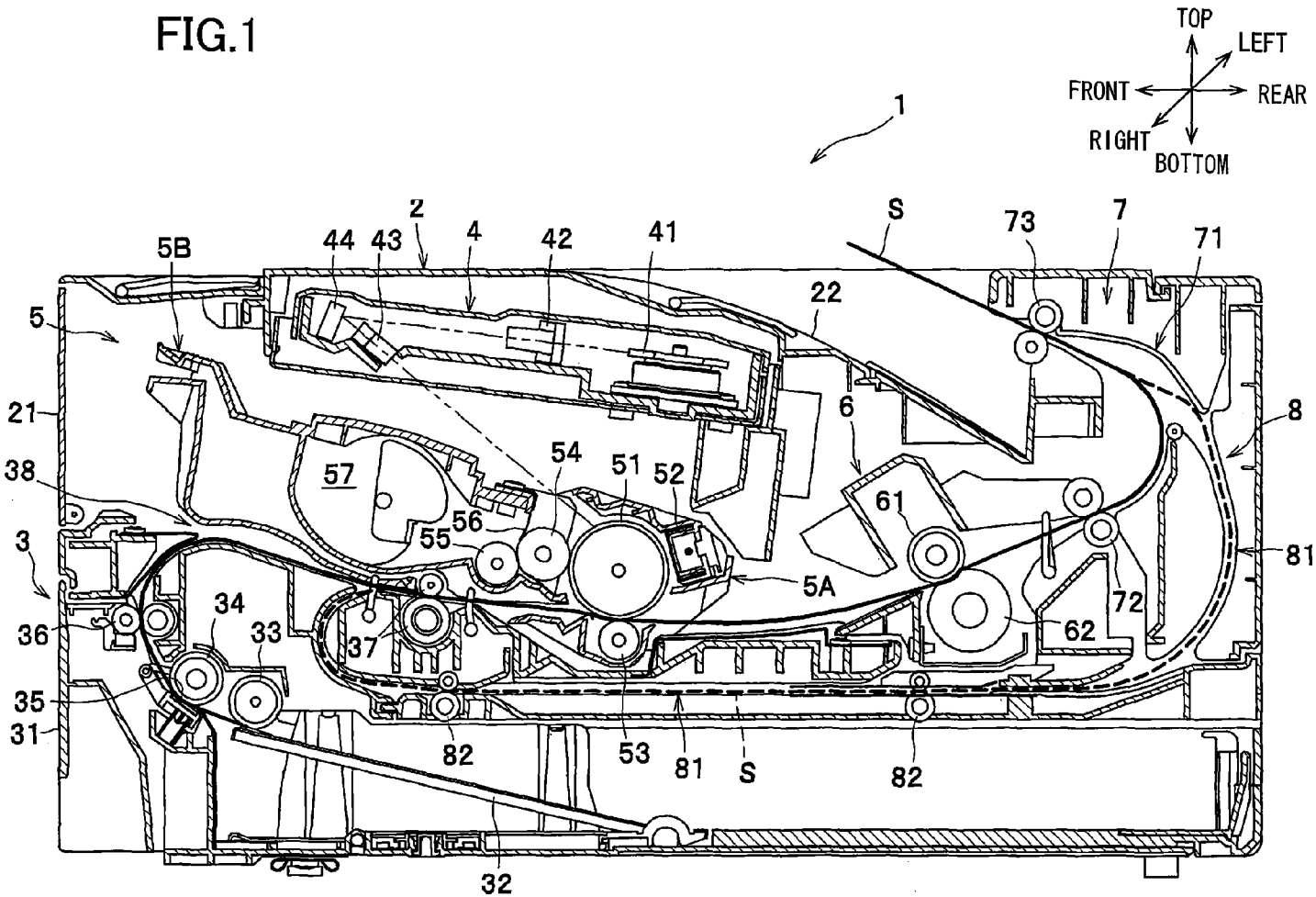
FIG. 1 is a schematic cross-sectional view of a laser printer embodying an image forming apparatus according to one embodiment of the present invention.

As shown in FIG. 1, the laser printer 1 is configured to be capable of forming an image on a front and rear surface of a sheet S as an example of a recording sheet. The laser printer 1 includes a main casing 2 constituting a main body. Within the main casing 2, a sheet supply unit 3, an exposure device 4, a process cartridge 5, a fixing device 6, a discharge unit 7, and a reverse unit 8 are provided.

Figure 4:
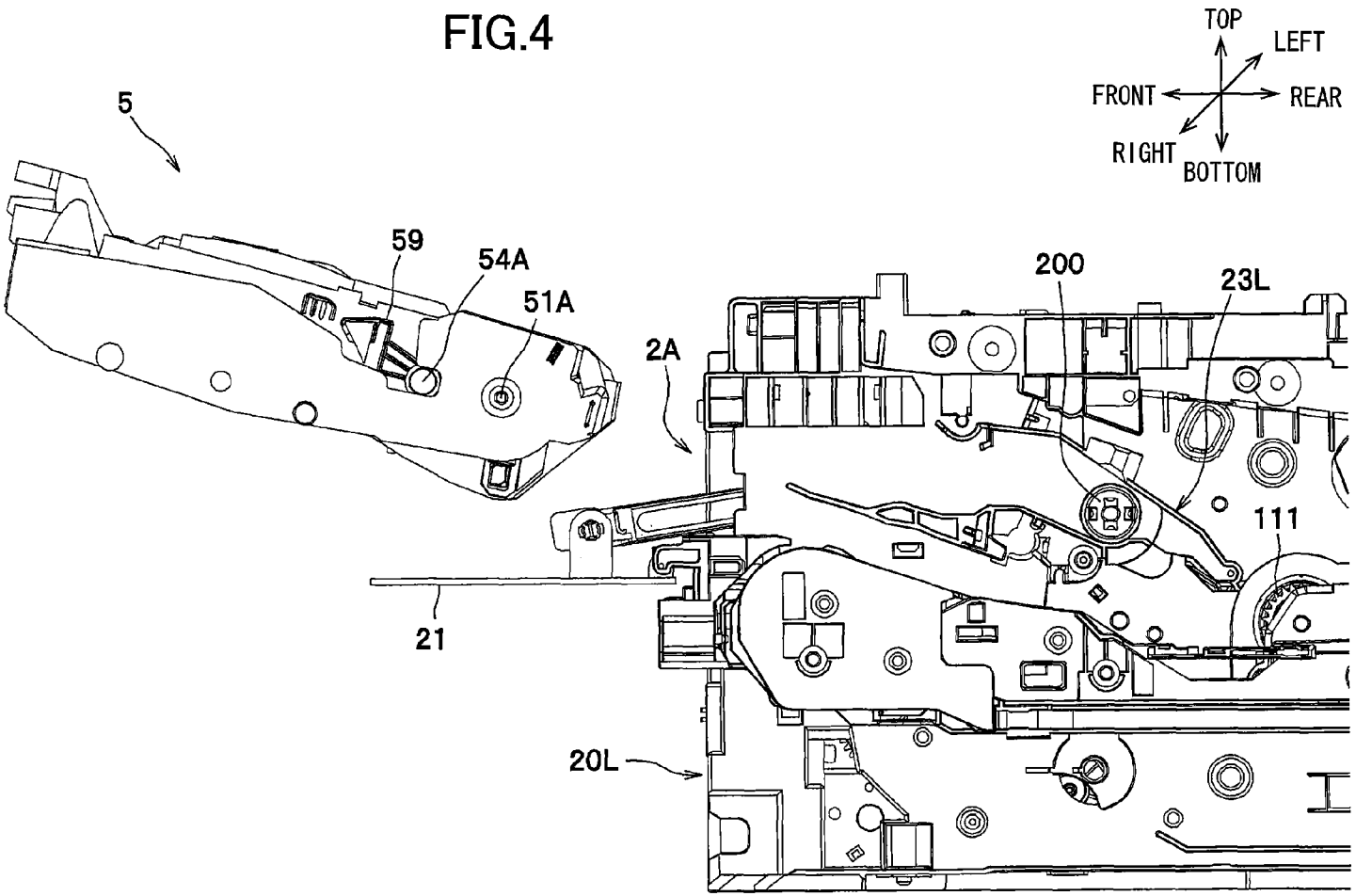
FIG. 4 is a side view of a left frame and a process cartridge, as viewed from an inner side of the left frame.

The laser printer 1 includes a front cover 21, as an example of a cover, positioned at a front side of the main casing 2. As shown in FIG. 4, the front cover 21 has a lower end pivotally connected to the main casing 2, and is pivotally movable about the lower end in a front-to-rear direction relative to the main casing 2. The front cover 21 is operable to cover or expose an opening 2A formed in the main casing 2 through which the process cartridge 5 is detached from or attached to the main casing 2.

The sheet supply unit 3 is disposed at a lower section of the main casing 2. The sheet supply unit 3 includes a sheet supply tray 31, an urging plate 32, a sheet supply roller 33, a separation roller 34, a separation pad 35, a conveying roller 36, and a pair of registration rollers 37. The sheets S accommodated in the sheet supply tray 31 are directed upward to the sheet supply roller 33 by the urging plate 32. Then, the topmost section of the sheets S are picked up and conveyed to the separation roller 34 by the sheet supply roller 33. The separation roller 34 separates and conveys the sheet S one sheet at a time in cooperation with the separation pad 35. The sheet S is further conveyed toward a position between a photosensitive drum 51 and a transfer roller 53 passing through the conveying roller 36 and the pair of the registration rollers 37.

The exposure device 4 is disposed at the upper section of the main casing 2. The exposure device 4 includes a laser emission unit (not shown), a rotationally driven polygon mirror 41, lenses 42, 43, and a reflection mirror 44. The laser emission unit is configured to emit a laser beam (indicated by a dotted line in FIG. 1) based on image data so that the laser beam is deflected by or passes through the polygon mirror 41, the lens 42, the reflection mirror 44, and the lens 43 in this order. A surface of the photosensitive drum 51 is subjected to high speed scan of the laser beam.

The process cartridge 5 is disposed below the exposure device 4. The process cartridge 5 is detachable or attachable (replaceable) relative to the main casing 2 through the opening 2A (shown in FIG. 4) defined by the front cover 21 at an open position. The process cartridge 5 includes a photosensitive drum unit 5A and a developing unit 5B.

The photosensitive drum unit 5A includes the photosensitive drum 51, as an example of a photosensitive member, rotatably supported on the main casing 2, a charger 52, and the transfer roller 53. The developing unit 5B is detachably mounted on the photosensitive drum unit 5A. The developing unit 5B includes a developing roller 54, a toner supply roller 55, a regulation blade 56, and a toner accommodating portion 57 in which toner as an example of a developer is accommodated.

In the process cartridge 5, after the surface of the photosensitive drum 51 has been uniformly charged by the charger 52, the surface is subjected to high speed scan of the laser beam from the exposure device 4. An electrostatic latent image based on the image data is thereby formed on the surface of the photosensitive drum 51. The toner accommodated in the toner accommodating portion 57 is supplied to the developing roller 54 via the toner supply roller 55. The toner is conveyed between the developing roller 54 and the regulation blade 56 so as to be deposited on the developing roller 54 as a thin layer having uniform thickness.

The toner deposited on the developing roller 54 is supplied to the electrostatic latent image formed on the photosensitive drum 51. Hence, a visible toner image (developer image) corresponding to the electrostatic latent image is formed on the photosensitive drum 51. Then, the sheet S is conveyed between the photosensitive drum 51 and the transfer roller 53, so that the toner image formed on the photosensitive drum 51 is transferred onto the sheet S.

The fixing device 6 is disposed rearward of the process cartridge 5. The fixing device 6 includes a heat roller 61 and a pressure roller 62 arranged in confrontation with the heat roller 61 to press the heat roller 61. While the sheet S passes between the heat roller 61 and the pressure roller 62, the toner image transferred onto the sheet S is thermally fixed. As a result, an image is formed on one surface (front surface) of the sheet S.

The discharge section 7 is disposed at a rear section of the main casing 2. The discharge section 7 provides a discharge path 71 and includes a conveying roller 72 and a discharge roller 73. The discharge roller 73 is configured to be capable rotating forward and in reverse by a known control method. When the discharge roller 73 is driven to rotate forward, the sheet S is discharged externally from the main casing 2. On the other hand, when the discharge roller 73 is driven to rotate in reverse, the sheet S is drawn back into the main casing 2 to form an image on another surface (rear surface) of the sheet S.

The sheet S discharged from the fixing device 6 is conveyed to the discharge path 71 by the conveying rollers 72. When image-forming has been completed, the sheet S is discharged from the main casing 2 by the discharge roller 73 which is rotationally driven forward so as to be placed on a discharge tray 22. When an image is formed on the rear surface of the sheet S, the discharge roller 73 is rotationally driven in reverse before the sheet S is entirely discharged from the main casing 2, so that the sheet S is drawn back into the main casing 2 to be conveyed toward the reverse section 8.

The reverse section 8 provides a reverse path 81 and includes a plurality of conveying rollers 82 disposed at the reverse path 81. The reverse path 81 extends downward from the upper rear section of the main casing 2, curves frontward to extend below the fixing device 6 and the process cartridge 5 toward the front section of the main casing 2 from the rear section, and again curves upward to extend toward the process cartridge 5.

The sheet S conveyed to the reverse section 8 (indicated by a broken line in FIG. 1) is conveyed by the conveying rollers 82 in the reverse path 81 toward the process cartridge 5. The sheet S is conveyed to the process cartridge 5 again, and passes between the photosensitive drum 51 and the transfer roller 53 to transfer a toner image thereonto. The toner image transferred onto the sheet S is thermally fixed to the sheet S while the sheet S passes through the fixing device 6, so that an image is formed on the rear surface of the sheet S. The sheet S discharged from the fixing device 6 is conveyed to the discharge path 71 by the conveying roller 72. The discharge roller 73 which is rotationally driven forward discharges the sheet S from the main casing 2, so that the sheet S is placed on the discharge tray 22.

<Detailed Structure of Laser Printer>

Next, a detailed structure of the laser printer 1 will be described.

Figure 2:
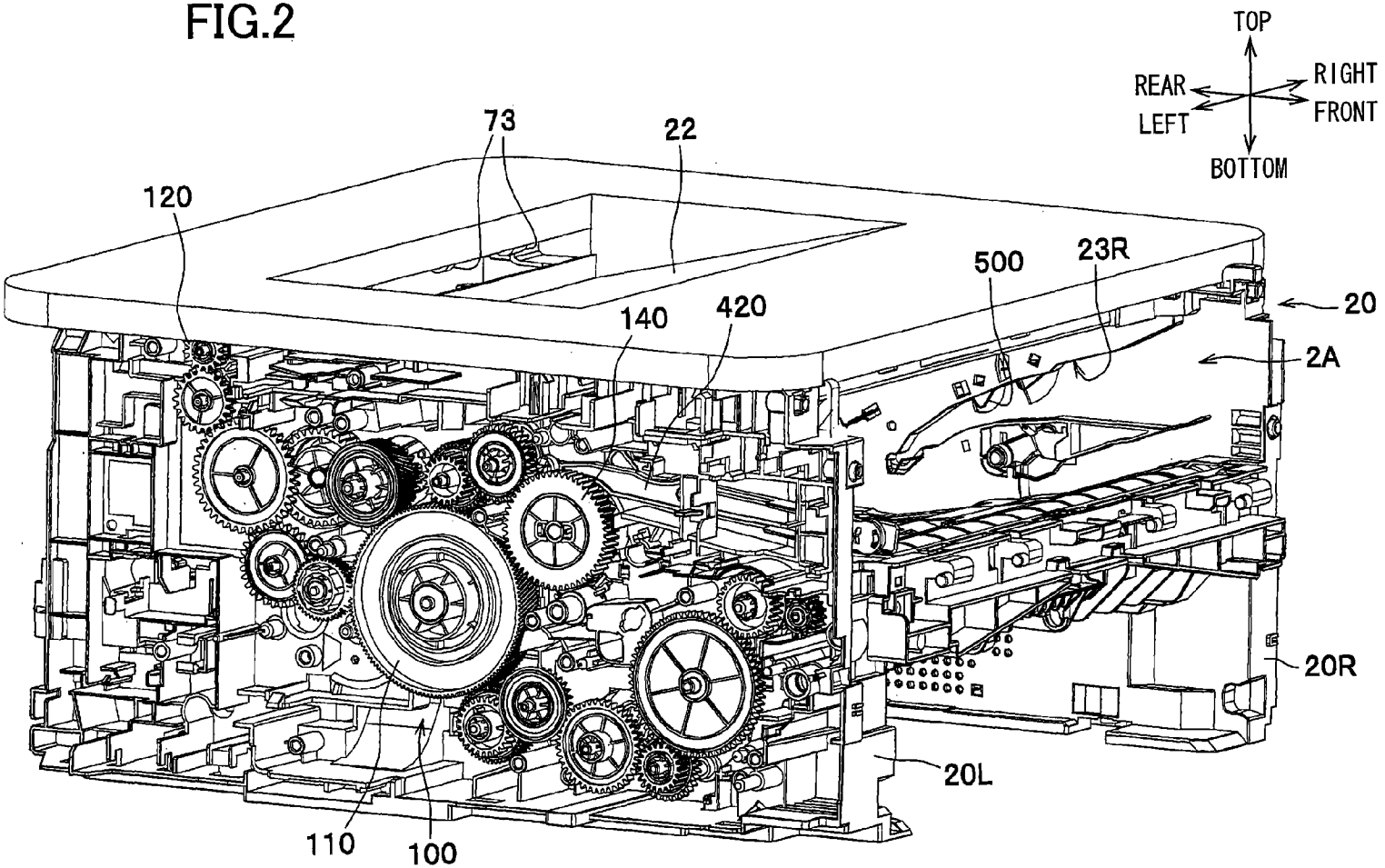
FIG. 2 is a perspective view showing a main frame of the laser printer.

As shown in FIG. 2, the laser printer 1 includes, within the main casing 2, a main frame 20 constituting the main body together with the main casing 2. The main frame 20 is for supporting the sheet supply tray 31, the exposure device 4, the process cartridge 5, and the fixing device 6. The main frame 20 includes a left frame 20L and a right frame 20R. The left frame 20L and the right frame 20R are arranged in confrontation with each other in a left-to-right direction.

The left frame 20L is formed with a guide groove 23L extending substantially in the front-to-rear direction (also refer to FIG. 4). The right frame 20R is formed with a guide groove 23R extending substantially in the front-to-rear direction. The guide grooves 23L and 23R as an example of a positioning guide are for guiding a shaft 51A of the photosensitive drum 51 (shown in FIGS. 4 and 8) when the process cartridge 5 is mounted on the main casing 2 (main frame 20). In addition, the guide grooves 23L and 23R define the position of the shaft 51A of the photosensitive drum 51 relative to the main frame 20 when the process cartridge 5 is mounted in the main frame 20, that is, when the shaft 51A of the photosensitive drum 51 has reached rear ends of the guide grooves 23L and 23R.

The left frame 20L is provided with a structure, such as a gear mechanism 100, for transmitting a driving force to the sheet supply section 3, the process cartridge 5, and the fixing device 6. The right frame 20R is provided with a structure, such as an electrode 500, for applying a voltage to the developing roller 54 of the process cartridge 5. The detailed structure of each frame relating to the present invention will hereinafter be described.

<Detailed Structure of Left Frame>

Figure 5A:
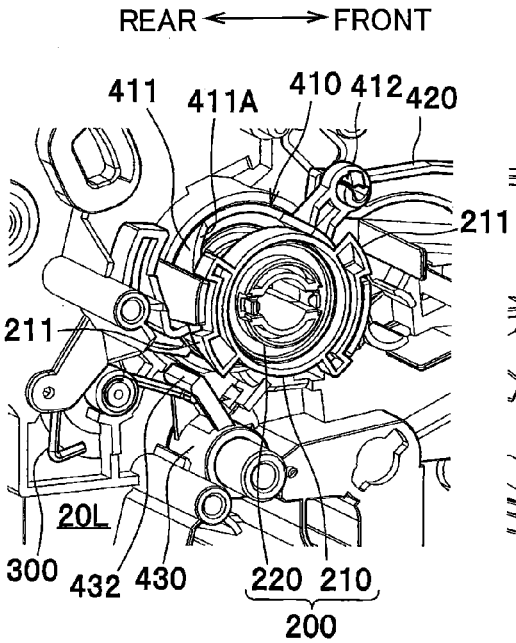
Figure 6A:
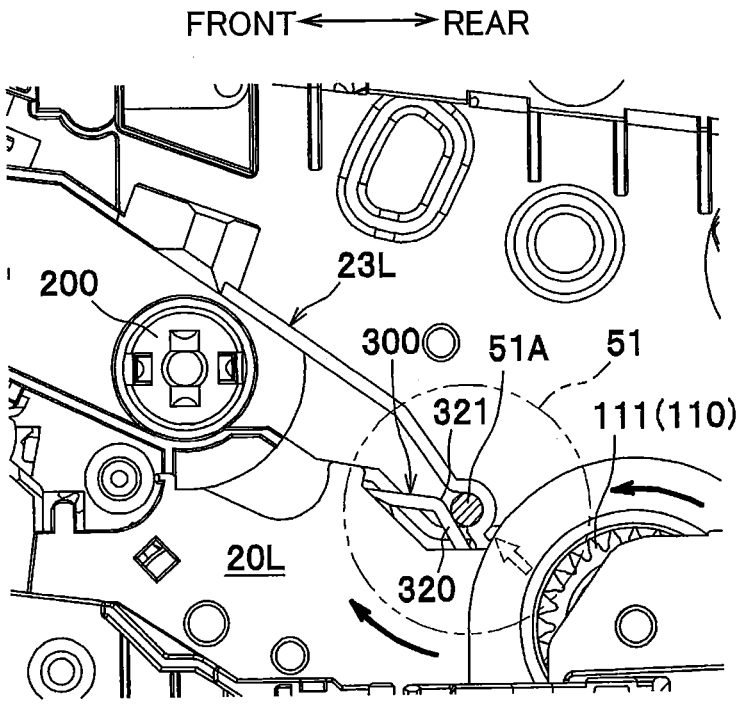
FIG. 6A is a view when a torsion spring is in a lock state, as viewed from the inner side of the left frame.
Figure 6B:
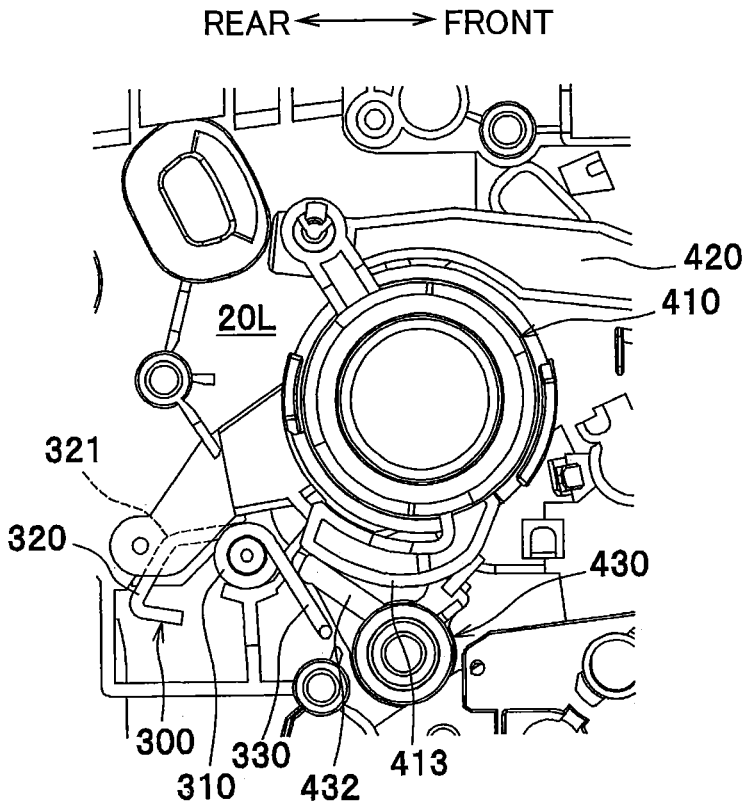
FIG. 6B is a view when the torsion spring is in the lock state, as viewed from the outer side of the left frame.
Figure 7:
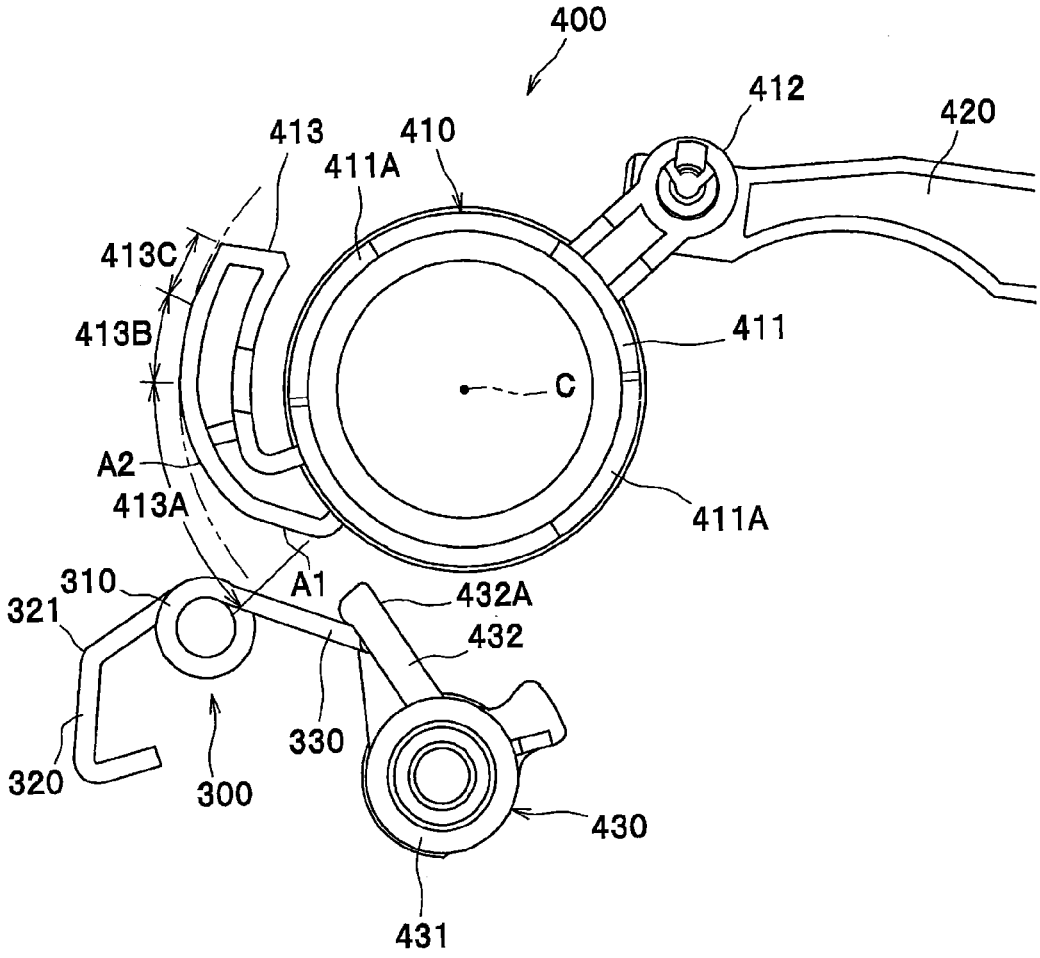
FIG. 7 is a view showing a structure of a regulating member control unit.

The left frame 20L includes the gear mechanism 100, an output coupling 200 as an example of a coupling member shown in FIGS. 4 and 5, a torsion spring 300 as an example of regulating member shown in FIGS. 6 and 7, and a regulating member control unit 400.

[Gear Mechanism]

Figure 3:
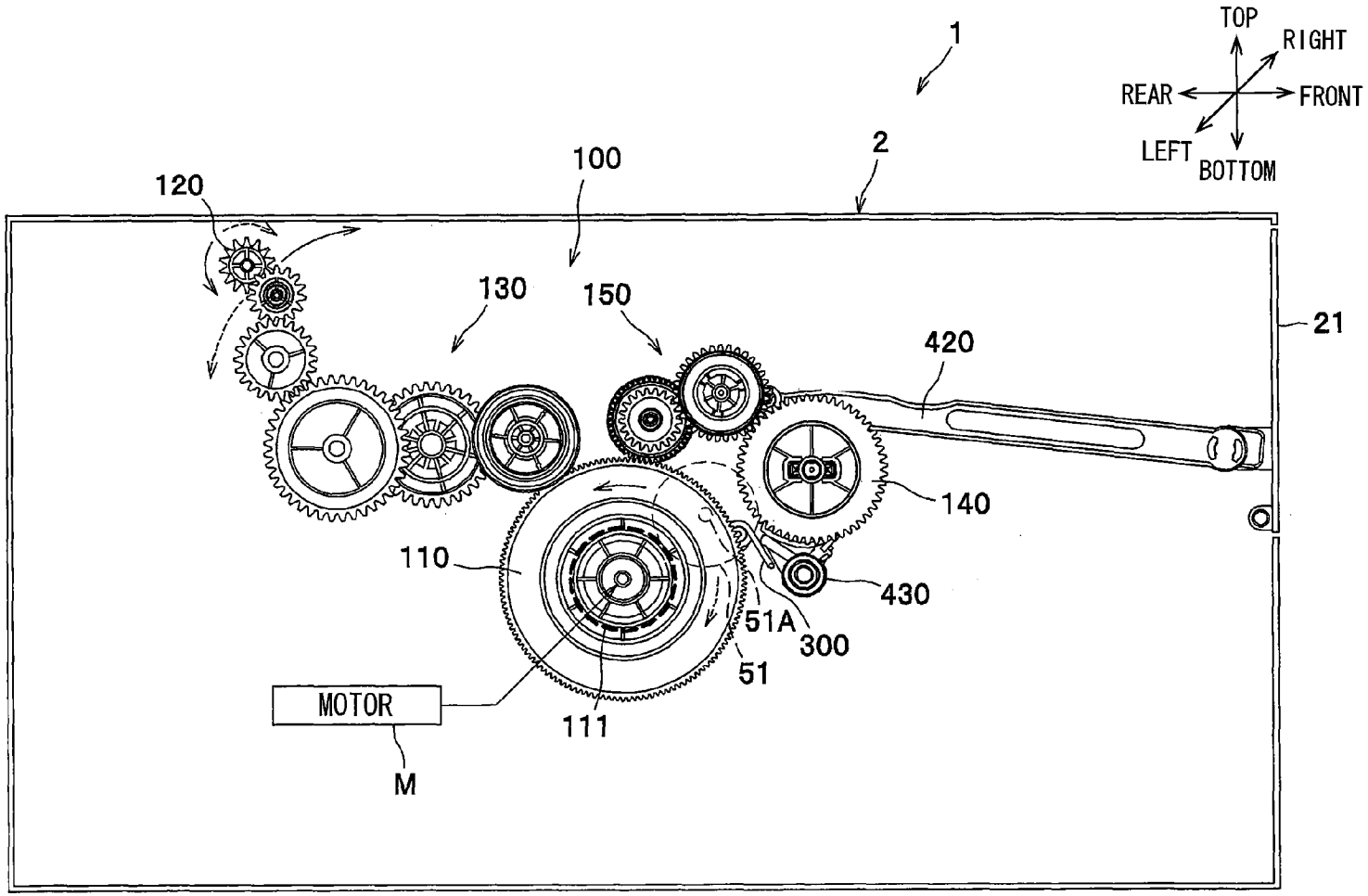
FIG. 3 is a schematic view showing a gear mechanism provided in the laser printer.

As shown in FIG. 3, the gear mechanism 100 includes a photosensitive drum drive gear 110, a discharge roller drive gear 120, a first gear train 130 for transmitting a driving force of the photosensitive drum drive gear 110 to the discharge roller drive gear 120, a coupling drive gear 140, and a second gear train 150 for transmitting the driving force of the photosensitive drum drive gear 110 to the coupling drive gear 140.

The photosensitive drum drive gear 110 is for transmitting the rotational driving force to the photosensitive drum 51 when the process cartridge 5 is being mounted in the main frame 20. More specifically, the photosensitive drum drive gear 110 is a multi-step gear. The photosensitive drum drive gear 110 includes an output gear section 111 provided at a right side thereof. The output gear section 111 is enagageable with a gear (not shown) provided at a left end of the photosensitive drum 51.

As shown in FIG. 4, the output gear section 111 has an upper portion that is exposed from an inner surface of the left frame 20L at a position diagonally below and rearward of the rear end of the guide groove 23L. The output gear section 111 is brought into engagement with the gear (not shown) provided at the left end of the photosensitive drum 51 when the process cartridge 5 is mounted in the main frame 20.

Referring back to FIG. 3, the photosensitive drum drive gear 110 is driven to rotate by a driving force supplied from a motor M as an example of a drive source provided at a suitable position within the main casing 2. The motor M is capable of rotating in a forward direction (forward rotation) and reverse direction (reverse rotation). The forward and reverse rotations of the motor M drive the photosensitive drum drive gear 110 in the forward and reverse rotations.

The discharge roller drive gear 120 is driven integrally with the discharge roller 73 (shown in FIG. 1). The discharge roller drive gear 120 is driven to rotate by the driving force supplied from the motor M via the first gear train 130. The discharge roller drive gear 120 (the discharge roller 73) is driven in the forward rotation (indicated by a solid arrow) when the sheet S is discharged from the main casing 2 and driven in the reverse rotation (indicated by a dashed arrow) when the sheet S is drawn back into the main casing 2.

At this time, the photosensitive drum drive gear 110 coupled to the discharge roller drive gear 120 via the first gear train 130 is driven in the forward rotation (indicated by a solid arrow) when the discharge roller 73 is driven in the forward rotation, and driven in the reverse rotation (indicated by a dashed arrow) when the discharge roller 73 is driven in the reverse rotation. The photosensitive drum drive gear 110 rotates the photosensitive drum 51 in reverse when the photosensitive drum drive gear 110 is driven in the reverse rotation.

The coupling drive gear 140 is for transmitting the rotational driving force to the output coupling 200 described later. The coupling drive gear 140 is driven to rotate by the driving force supplied from the motor M via the second gear train 150.

[Output Coupling]

As shown in FIGS. 4 and 5, the output coupling 200 is for transmitting the rotational driving force to the developing roller 54 and the toner supply roller 55. More specifically, the output coupling 200 is engageable with an input coupling 58 (shown in FIG. 8A) provided at a left side of the process cartridge 5. When the output coupling 200 is rotationally driven while being in engagement with the input coupling 58, the output coupling 200 transmits the rotational driving force to the developing roller 54 via the input coupling 58 and a plurality of gears (not shown) provided in the process cartridge 5 (developing unit 5B).

The output coupling 200 is configured to move in an axial direction of the developing roller 54 (left-to-right direction). More specifically, when the process cartridge 5 is being mounted in the main frame 20, the output coupling 200 protrudes toward the process cartridge 5 (moves rightward) by moving the front cover 21 to the closed position so as to be brought into engagement with the input coupling 58 (shown in FIG. 5D). As a result, the output coupling 200 can transmit the rotational driving force to the developing roller 54.

Figure 5B:
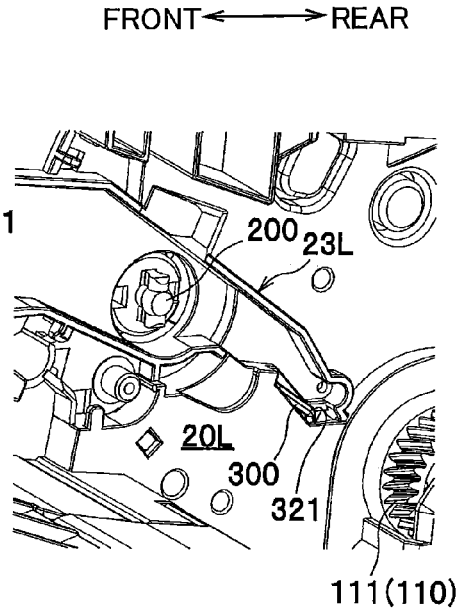

The output coupling 200 is retracted from the process cartridge 5 (moves leftward) by moving the front cover 21 to the open position so as to be spaced away from the process cartridge 5 (shown in FIG. 5B). As a result, the output coupling 200 is disengaged from the input coupling 58. Hence, the process cartridge 5 can be removed from the main frame 20.

Figure 5C:
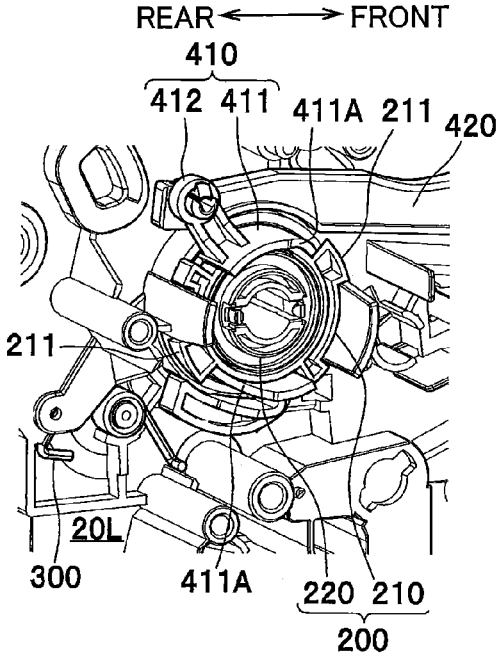

As shown in FIGS. 5A and 5C, the output coupling 200 includes a supporting portion 210 movable in the left-to-right direction and a coupling portion 220 for transmitting the rotational driving force to the developing roller 54. The output coupling 200 is urged rightward (toward the process cartridge 5 mounted in the main frame 20) by a spring (not shown).

The supporting portion 210 is positioned at an outer side (left side) of the left frame 20L. The supporting portion 210 is movable in the left-to-right direction relative to the left frame 20L. The supporting portion 210 is formed in a substantially cylindrical shape.

The coupling portion 220 is inserted in the supporting portion 210, and rotatably movable. The coupling portion 220 with the supporting portion 210 is movable relative to the left frame 20L in the left-to-right direction. The driving force inputted in the coupling drive gear 140 (shown in FIG. 3) rotationally drives the coupling portion 220.

Here, a movement mechanism of the output coupling 200 will be described. As shown in FIG. 5A, the movement mechanism of the output coupling 200 includes a rotation member 410 for moving the output coupling 200 in association with its rotation movement, and a link member 420 (shown in FIG. 9 as well) for rotating the rotation member 410 in association with movement of the front cover 21 between the open position and the closed position.

The rotation member 410 is positioned at the outer side of the left frame 20L. The rotation member 410 includes a main portion 411 formed in a substantially cylindrical shape, a connecting portion 412 extending outwardly in a radial direction from an outer circumferential surface of the main portion 411.

The main portion 411 is rotatably supported on the left frame 20L. The main portion 411 has a left circumferential edge with which a pair of slant surfaces 411A, 411A is provided. Each of the slant surfaces 411A are arranged in confrontation with each other in the radial direction.

In FIG. 5A, the slant surface 411A extends diagonally inward (rightward) from an outer (left) circumferential edge of the main portion 411 in a clockwise direction. In FIG. 5A showing a state in which the front cover 21 is in the open position, a protruding portion 211 provided at the supporting portion 210 of the output coupling 200 is in contact with the main portion 411 at a position past a topmost position of the slant surfaces 411A. In other words, the protruding portion 211 contacts with the leftmost position of the main portion 411. As this time, the output coupling 200 is in a retracted state, as shown in FIG. 5B.

The link member 420 has a rear end connected to the connecting portion 412 of the rotation member 410 and a front end connected to the front cover 21 (shown in FIG. 3). The link member 420 is configured to move in front-to-rear direction in response to the movement of the front cover 21 between the open position and to the closed position. More specifically, the link member 420 moves frontward when the front cover 21 is moved to the open position, and moves rearward when the front cover 21 is moved to the closed position.

Figure 5D:
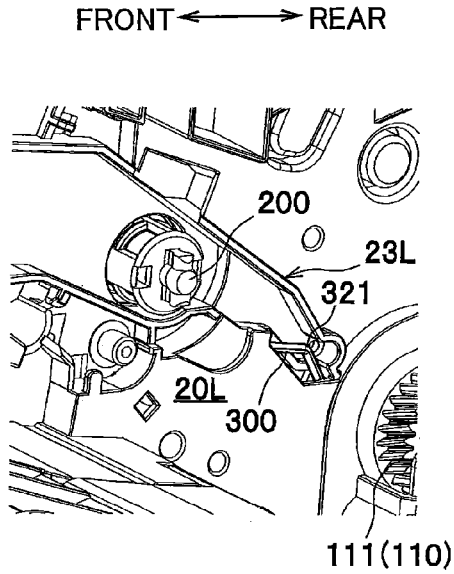

When the front cover 21 is moved to the closed position from the state shown in FIG. 5A, as shown in FIG. 5C, the rear end of the link member 420 moves rearward to rotate the rotation member 410 counterclockwise. As a result, the protruding portion 211 of the output coupling 200 which has been urged rightward slides down the slant surfaces 411A. The protruding portion 211 is brought into contact with the main portion 411 at a position past a downmost position of the slant surfaces 411A. At this time, the supporting portion 210 is moved rightward by the urging force of the spring (not shown). Hence, as shown in FIG. 5D, the output coupling 200 protrudes rightward from the left frame 20L.

When the front cover 21 is moved to the open position from the state shown in FIG. 5C, as shown in FIG. 5A, the rear end of the link member 420 is moved frontward to rotate the rotation member 410 clockwise. As a result, the protruding portion 211 of the output coupling 200 slides up the slant surfaces 411A against the urging force of the spring (not shown), so as to be brought into contact with the main portion 411 at the position past the topmost position of the slant surfaces 411A. At this time, the supporting portion 210 is moved leftward. Hence, as shown in FIG. 5B, the output coupling 200 is retracted.

[Torsion Spring]

As shown in FIG. 6B, the torsion spring 300 is positioned at the outer side of the left frame 20L. The torsion spring 300 includes a helically-coiled coil portion 310, a rear arm 320 extending rearward from the coil portion 310 and a front arm 330 extending frontward from the coil portion 310. The torsion spring 300 is pivotally supported to the left frame 20L about the coil portion 310.

The rear arm 320 has a folding portion 321 at a substantial center thereof. The folding portion 321 is formed in a V-shape with an obtuse angle. In association with pivotal movement of the torsion spring 300, the folding portion 321 is movable, in the vicinity of the rear end of the guide groove 23L, between a protruding position (shown in FIG. 5D) in which the folding portion 321 protrudes in the guide groove 23L and a retracted position (shown in FIG. 5B) in which the folding portion 321 is retracted from the guide groove 23L.

As shown in FIG. 6A, in a state of the folding portion 321 protruding in the guide groove 23L, the shaft 51A of the photosensitive drum 51 of the process cartridge 5 which is mounted in the main frame 20 is pinched between the rear end of the guide groove 23L and the rear arm 320.

Note that, in the present embodiment, the torsion spring 300 is positioned at a side the same as that at which the first gear 110 is positioned in the axial direction of the photosensitive drum 51 (left-to-right direction). The output coupling 200 and its movement mechanism (the rotation member 410 and the link member 420) are positioned at a side the same as that at which the torsion spring 300 is positioned in the left-to-right direction.

[Regulating Member Control Unit]

As shown in FIG. 7, the regulating member control unit 400 is brought the torsion spring 300 into a lock state described later (shown in FIGS. 6A and 6B) when the front cover 21 is moved to the closed position, and is brought the torsion spring 300 into an unlock state described later (shown in FIG. 13) when the front cover 21 is moved to the open position. The regulating member control unit 400 is positioned at the outer side of the left frame 20L. The regulating member control unit 400 includes the rotation member 410, the link member 420, and a pressure transmission member 430.

The rotation member 410 is rotatable, and rotation of the rotation member 410 allows the torsion spring 300 to be in the lock state or the unlock state via the pressure transmission member 430. The rotation member 410 further includes a cam portion 413, in addition to the main portion 411 and the connecting portion 412 described above.

The cam portion 413 radially outwardly protrudes from the outer circumferential surface of the main portion 411 in the opposite side of the connecting portion 412 with respect to a rotation axis C, and extends along the outer circumferential surface in a direction opposite to the pressure transmission member 430 (clockwise direction) to form a substantially arcuate shape.

The cam portion 413 has a pressing surface (no reference numeral) for pressing the pressure transmission member 430 when the front cover 21 is moved to the closed position from the open position. The pressing surface of the cam portion 413 includes a first pressing surface 413A, a second pressing surface 413B, and a third pressing surface 413C.

The first pressing surface 413A is firstly brought into contact with the pressure transmission member 430 by moving the front cover 21 toward the closed position. The first pressing surface 413A has a cam profile so as to gradually rotate (displace) the pressure transmission member 430 as the front cover 21 is moved toward the closed position (shown in FIG. 10).

The second pressing surface 413B continuously extends from the first pressing surface 413A. The second pressing surface 413B has an arcuate cam profile, and is arranged in a concentric manner with respect to the rotation member 410. That is, the center of the second pressing surface 413B is the rotation axis C.

The third pressing surface 413C continuously extends from the second pressing surface 413B. The third pressing surface 413C is flat and has a radial distance from the rotation axis C that is smaller than that of the second pressing surface 413B. More specifically, the flat third pressing surface 413C extends diagonally from an edge of the second pressing surface 413B so as to gradually reduce the radial distance from the rotation axis C.

The pressure transmission member 430 includes a cylindrical portion 431 that is rotatably supported to the left frame 20L and an arm 432 radially outwardly extending from the cylindrical portion 431. The pressure transmission member 430 is configured to be pivotable relative to the left frame 20L about the cylindrical portion 431.

The pressure transmission member 430 will be described later in detail. When the output coupling 200 protrudes in association with rotation movement of the rotation member 410 (when the front cover 21 is moved to the closed position), the cam portion 413 presses the arm 432 to rotate the pressure transmission member 430. Hence, the arm 432 presses the torsion spring 300, so that the pressure transmission member 430 allows the torsion spring 300 to be in the lock state (shown in FIG. 6B).

Figure 13:
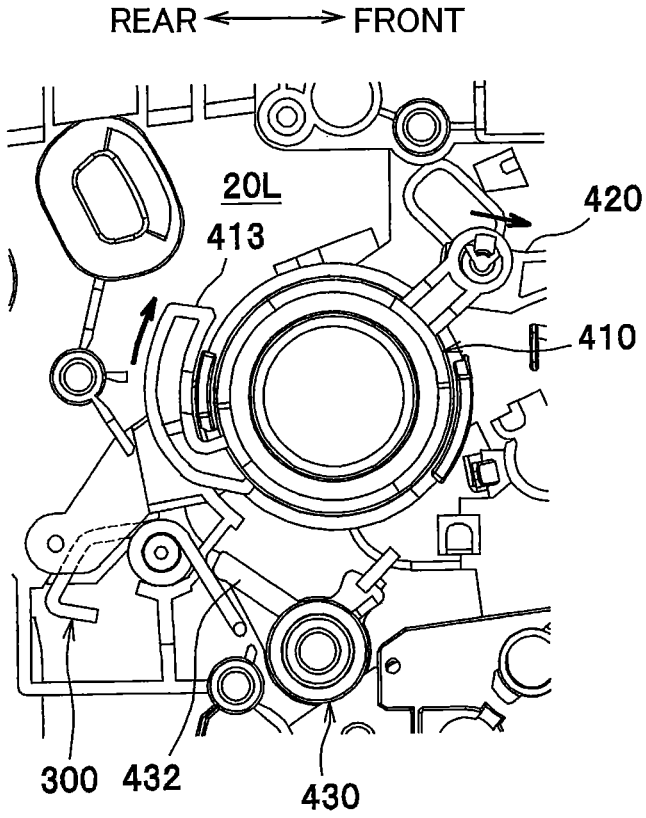
FIG. 13 is a view showing the torsion spring in an unlock state.

When the output coupling 200 is retracted in association with rotation movement of the rotation member 410 (when the front cover 21 is moved to the open position), pressure of the cam portion 413 against the arm 432 is released so that the pressure transmission member, 430 allows the torsion spring 300 to be in the unlock state (shown in FIG. 13).

The arm 432 has a flat front surface 432A. The front surface 432A contacts with the third pressing surface 413C of the rotation member 410 when the torsion spring 300 is in the lock state (shown in FIG. 12).

<Detailed Structure of Right Frame>

Figures 8A, 8B:
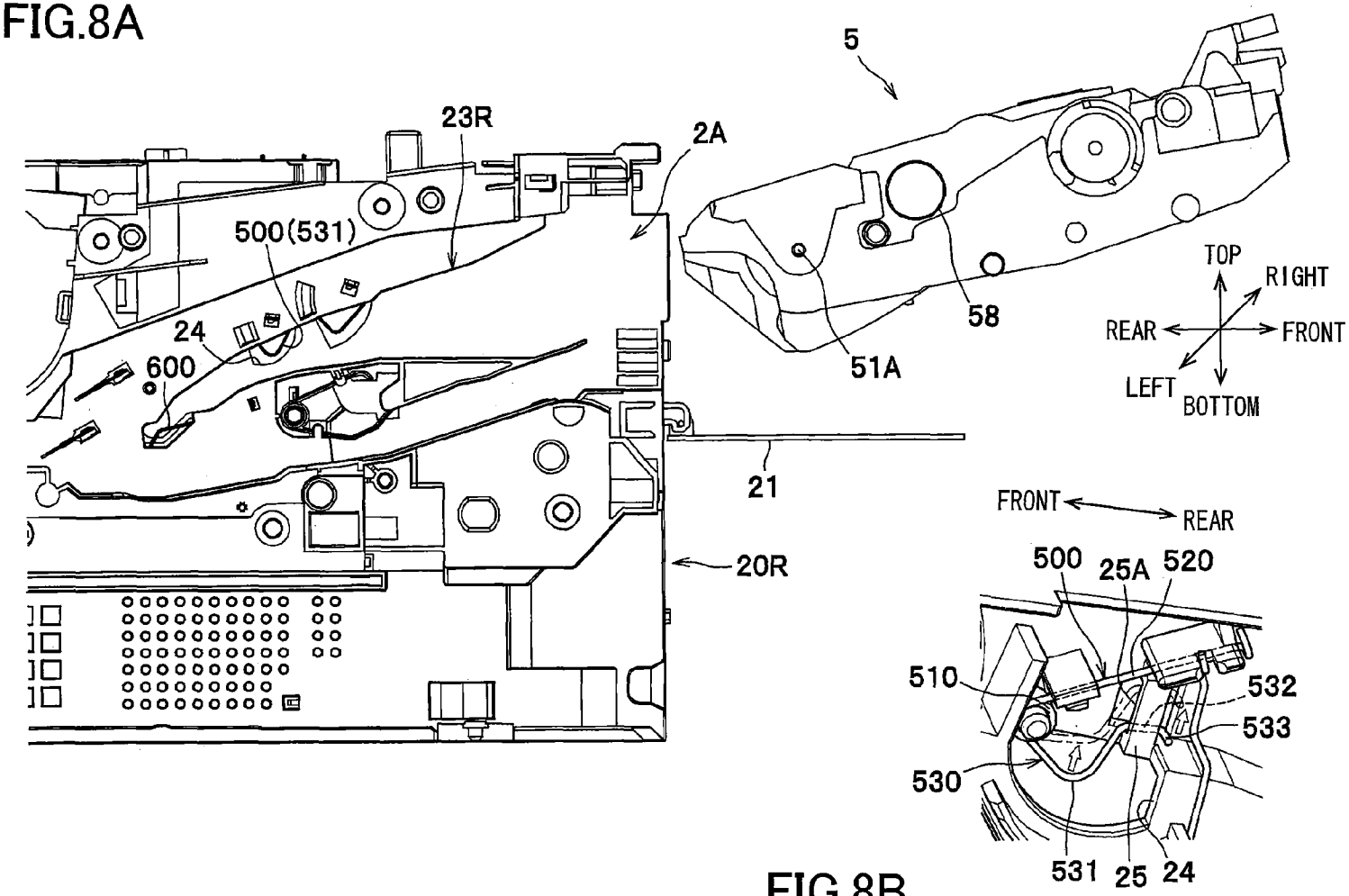
FIG. 8A is a side view of a right frame and the process cartridge as viewed from an inner side of the right frame.
FIG. 8B is a perspective view showing a structure of an electrode as viewed from an outer side of the right frame.

As shown in FIG. 8A, the right frame 20R is provided with the electrode 500 and a torsion spring 600.

The electrode 500 is for applying developing bias to the developing roller 54 of the process cartridge 5. The electrode 500 is provided at a position in confrontation with an electrically conductive member 59 (shown in FIG. 4) positioned at a right side of the process cartridge 5 when the process cartridge 5 is being mounted in the main frame 20.

As shown in FIG. 4, the electrically conductive member 59 is formed of electrically conductive resin, and configured to be in electrically contact with a shaft 54A of the developing roller 54. With this configuration, the developing bias can be applied to the developing roller 54 from the electrode 500 via the electrically conductive member 59.

As shown in FIG. 8B, the electrode 500 is positioned at an outer side (right side) of the right frame 20R. The electrode 500 includes a helically-coiled coil portion 510, an upper arm 520 extending diagonally above and rearward from the coil portion 510, and a lower arm 530 extending diagonally below and rearward from the coil portion 510.

The lower arm 530 includes a contact portion 531 bent into a substantially V-shape, an extending portion 532 extending rearward from a rear end of the contact portion 531, and an engagement portion 533 orthogonally bent outward (rightward) from a rear end of the extending portion 532.

The contact portion 531 protrudes into the guide groove 23R through an opening 24 formed in the guide groove 23R. When the process cartridge 5 is mounted in the main frame 20 and the electrically conductive member 59 of the process cartridge 5 contacts with the contact portion 531, the entire portion of the lower arm 530 is bent upward (indicated by broken lines).

The extending portion 532 extends through a through hole 25A defined between an outer surface of the right frame 20R and a substantially U-shaped regulating member 25 provided on the outer surface of the right frame 20R. Hence, the extending portion 532 is covered by the regulating member 25 when the right frame 20R is viewed from the outer side thereof.

With this configuration, deformation of the lower arm 530 such that the lower arm 530 is spaced away from the outer surface of the right frame 20R can be prevented when the electrically conductive member 59 contacts with the lower arm 530 to bend the lower arm 530 upward. Further, the extending portion 532 has the rear end from which the engagement portion 533 extends so as to be bent outward. Therefore, the engagement portion 533 can prevent the extending portion 532 from disengaging from the regulating member 25 when the lower arm 530 is bent upward. This configuration stabilizes the position of the electrode 500.

Further, when the lower arm 530 is bent upward, the extending portion 532 and the engagement portion 533 can be moved along the regulating member 25. Hence, lateral displacement of the lower arm 530 in the left-to-right direction can be prevented. Accordingly, load applied to the electrode 500 from the electrically conductive member 59 can be stabilized.

Referring back to FIG. 8A, the torsion spring 600 is for urging the shaft 51A of the photosensitive drum 51 toward a rear end of the guide groove 23R when the process cartridge 5 is mounted in the main frame 20, thereby positioning the shaft 51A of the photosensitive drum 51 relative to the main frame 20 (the right frame 20R).

In the present embodiment, the torsion spring 600 has strength such that the torsion spring 600 is easily resiliently deformable when the process cartridge 5 is mounted to or removed from the main frame 20. On the other hand, the torsion spring 300 provided in the left frame 20L has a strength such that the torsion spring 300 is not resiliently deformable even if a user intends to mount/remove the process cartridge 5 to/from the main frame 20 when the torsion spring 300 is in the lock state with a power the same as a power when the user normally mounts/removes the process cartridge 5 to/from the main frame 20 in the unlock state of the torsion spring 300.

<Operation of Laser Printer>

Next, an operation of the laser printer 1 will be described.

Figure 9:
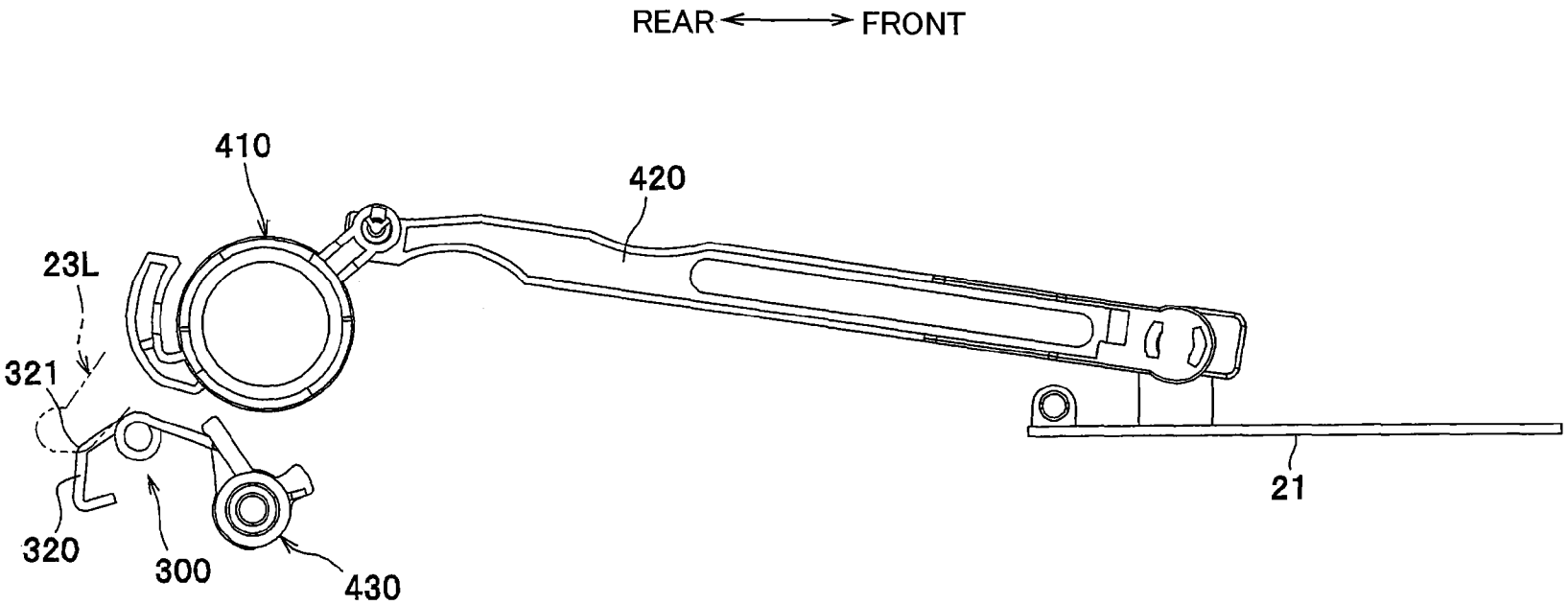
FIG. 9 is a view showing the regulating member control unit and the torsion spring in an open state of the front cover.
Figure 14A:
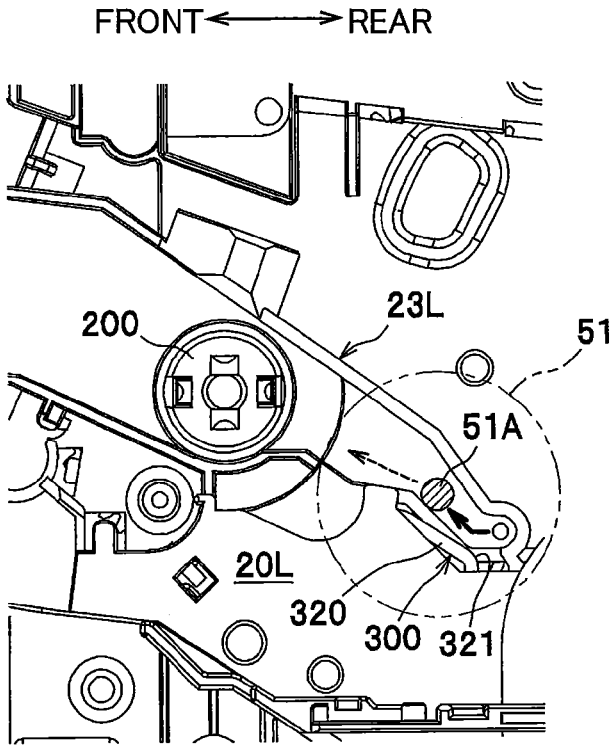
FIG. 14A is an explanatory view for explaining an operation in removing the process cartridge as viewed from the inner side of the left frame.

As shown in FIG. 9, in an open state of the front cover 21, the folding portion 321 of the torsion spring 300 (rear arm 320) is retracted from the guide groove 23L (also shown in FIG. 14A). In this state, firstly, the process cartridge 5 is mounted to the main casing 2 (the main frame 20).

Figure 10:
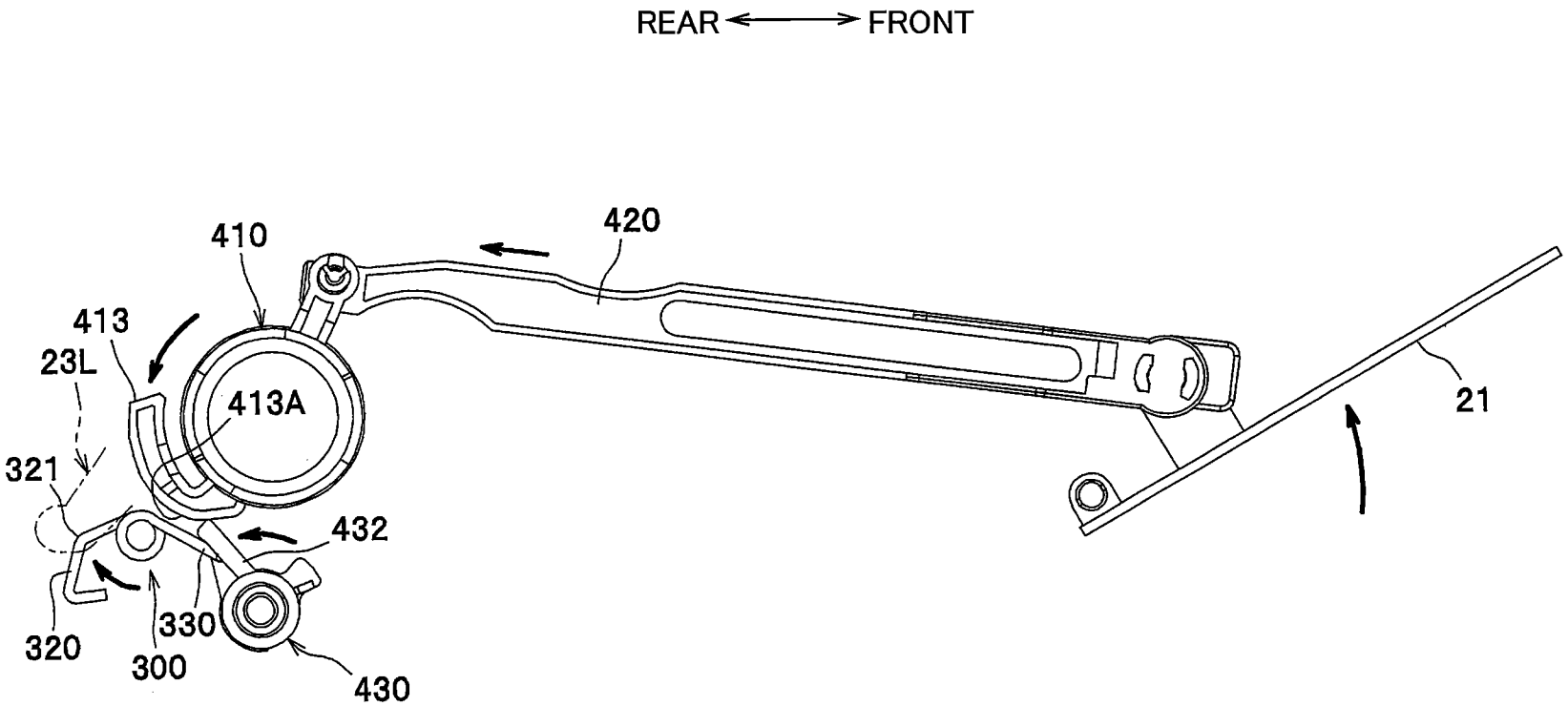
FIG. 10 is a view showing a state in which a first pressing surface rotatably moves a pressure transmission member.

Thereafter, as shown in FIG. 10, when the front cover 21 is moved toward the closed position, the rear end of the link member 420 is moved rearward so as to rotate the rotation member 410 counterclockwise. Then, the first pressing surface 413A of the cam portion 413 is brought into contact with the arm 432 of the pressure transmission member 430. When the front cover 21 is further moved toward the closed position, the first pressing surface 413A pivotally moves the arm 432 rearward.

The arm 432 of the pressure transmission member 430 is in contact with the front arm 330 of the torsion spring 300. Rearward movement of the arm 432 allows the arm 432 to press the front arm 330, so that the front arm 330 is pivotally moved downward. In association with this movement, the rear arm 320 of the torsion spring 300 is pivotally moved upward.

Here, as shown in FIG. 7, the first pressing surface 413A has a front surface A1 positioned at a front side thereof and a rear surface A2 positioned at a rear side thereof in the counterclockwise direction. The front surface A1 is slanted at an angle steeper than that of the rear surface A2 with respect to the second pressing surface 413B having an arc shape. With this configuration, the pressure transmission member 430 can be swiftly moved by the front surface A1 at an initial phase of closing the front cover 21 to which a power to move the front cover 21 is easily transmitted. Thereafter, as the rear surface A2 is gently slanted, a load of the rear surface A2 can be reduced in further closing the front cover 21.

Figure 11:
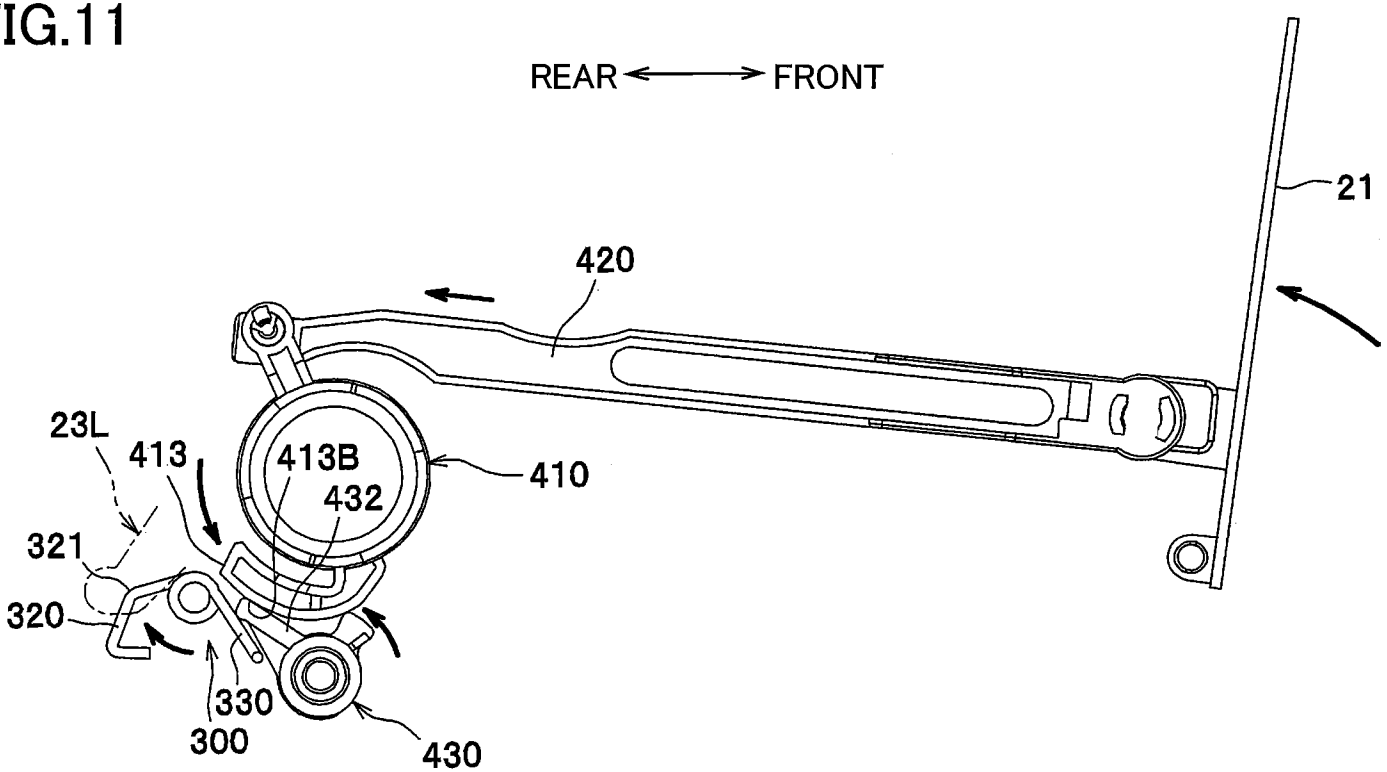
FIG. 11 is a view showing a state in which a second pressing surface is brought into sliding contact with the pressure transmission member.

As shown in FIG. 11, the front cover 21 is still further moved toward the closed position, the second pressing surface 413B is brought into sliding contact with the arm 432. The second pressing surface 413B is formed with a partial cylindrical surface arranged concentrically with the rotation member 410. Hence, a load of the second pressing surface 413B applied from the torsion spring 300 via the arm 432 can be reduced as well as the load can be applied in a uniform manner.

As a result, a load of the front cover 21 applied from the torsion spring 300 can be reduced, and the front cover 21 can be moved to the closed position at a constant power. In the present embodiment, the torsion spring 300 and the regulating member control unit 400 are only provided in the left frame 20L. Therefore, there is a difference between a load applied to a left side of the front cover 21 and a load applied to a right side of the front cover 21. However, the above described configuration can minimize this difference.

Figures 12A, 12B:
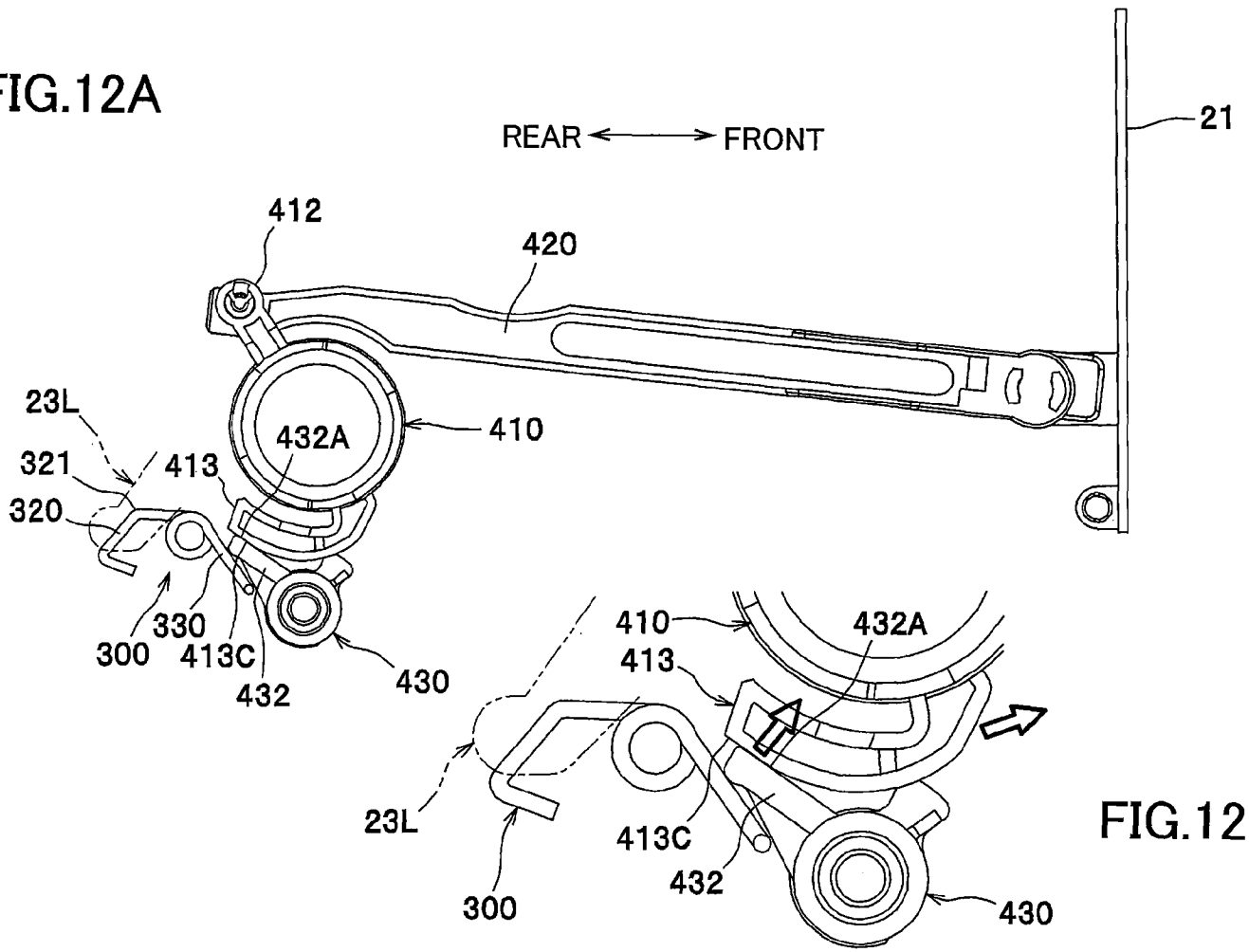
FIG. 12A is a view showing the regulating member control unit and the torsion spring when the front cover is in a closed state.
FIG. 12B is an enlarged view of a portion adjacent to a cam portion when the front cover is in the closed state.

As shown in FIG. 12A, the front cover 21 is still further moved toward the closed position, the third pressing surface 413C is brought into sliding contact with the arm 432. When the third pressing surface 413C is in contact with the front surface 432A of the arm 432, pivotal movement of the front cover 21 stops. Hence, the front cover 21 reaches the closed position. When the front cover 21 is at its closed position, a cover lock member (not shown) provided in the main casing 2 locks (maintains) the front cover 21 in a closed state.

Here, the third pressing surface 413C continuously extends from the second pressing surface 413B, and is not arcuate but flat. Further, the third pressing surface 413C has a distance from the rotation axis C of the rotation member 410 smaller than that of the second pressing surface 413B. As shown in FIG. 12B, a force applied to the third pressing surface 413C from the torsion spring 300 via the arm 432 acts as a force to rotate the rotation member 410 counterclockwise (indicated by an arrow). This force acts as a force in which the connecting portion 412 moves the link member 420 rearward, and thereby resulting in a force acting in a direction to move the front cover 21 to the closed position. Hence, the front cover 21 can be easily moved to the closed position and reliably maintained its closed state.

In the closed state of the front cover 21, as shown in FIG. 6A, the folding portion 321 of the torsion spring 300 (rear arm 320) protrudes into the guide groove 23L. At this time, the rear arm 320 pinches the shaft 51A of the photosensitive drum 51 of the process cartridge 5 with the rear end of the guide groove 23L to regulate the shaft 51A not to be moved in a mounting/removing direction of the process cartridge 5 (substantially front-to-rear direction). Such a state of the torsion spring 300 is referred to as the "lock state." In other words, in the lock state, the rear arm 320 of the torsion spring 300 prohibits the shaft 51A of the photosensitive drum 51 from moving in the mounting/removing direction.

When the photosensitive drum drive gear 110 is driven in the reverse rotation, a force (indicated by dashed arrow in FIG. 6A) is generated and acts on the photosensitive drum 51 so that the photosensitive drum 51 is pressed diagonally above and frontward. However, in the lock state, displacement of the shaft 51A of the photosensitive drum 51 is regulated by the torsion spring 300. Therefore, displacement of the photosensitive drum 51 can be prevented.

When the front cover 21 is moved to the open position, as shown in FIG. 13, the rear end of the link member 420 is moved frontward to rotate the rotation member 410 in the clockwise direction. As a result, the cam portion 413 is separated from the arm 432. Therefore, the pressure applied by the cam portion 413 against the arm 432 can be released.

Figure 14B:
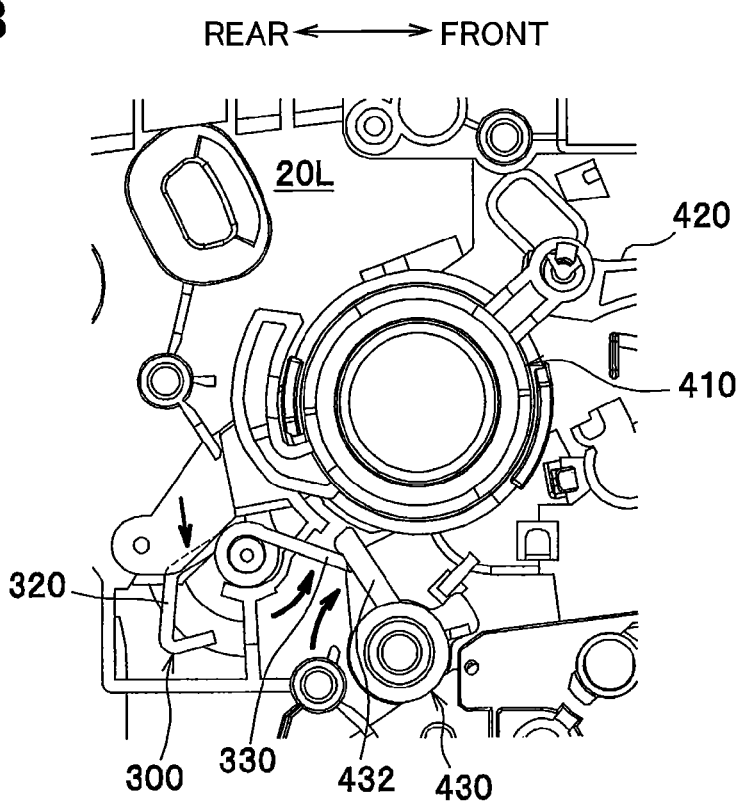
FIG. 14B is an explanatory view for explaining the operation in removing the process cartridge as viewed from the outer side of the left frame.

In this state, when attempting to remove the process cartridge 5 from the main frame 20, as shown in FIGS. 14A and 14B, the shaft 51A of the photosensitive drum 51 presses the torsion spring 300 to pivotally move the rear arm 320 downward. As a result, the folding portion 321 is retracted from the guide groove 23L. Accordingly, the process cartridge 5 can be removed from the main casing 2 (main frame 20). Such a state of the torsion spring 300 that the shaft 51A of the photosensitive drum 51 is not regulated by the torsion spring 300 (shown in FIG. 13) is referred to as the "unlock state." In other words, in the unlock state, the shaft 51A of the photosensitive drum 51 is released from the torsion spring 300.

According to the above-described embodiment, operational effects can be achieved as described below.

In the mounted state of the process cartridge 5 in the main casing 2 (main frame 20), the left frame 20L is provided with the torsion spring 300 that is capable of being in the lock state to regulate the shaft 51A of the photosensitive drum 51 not to be moved and in the unlock state to release the regulation. Accordingly, maintaining the torsion spring 300 in the lock state can prevent displacement of the photosensitive drum 51 when the photosensitive drum drive gear 110 is driven in the reverse rotation.

Hence, displacement of the photosensitive drum 51 relative to the main casing 2 can be prevented. Therefore, the quality of images formed in the laser printer 1 can be improved. Further, displacement of the photosensitive drum 51 may cause insufficient engagement of the photosensitive drum drive gear 110 with the gear (not shown) provided in the photosensitive drum 51. However, prevention of displacement of the photosensitive drum 51 can also prevent such insufficient engagement. Therefore, operational failure of the laser printer 1 can be avoided.

The regulating member control unit 400 allows the torsion spring 300 to be in the lock state in response to the movement of the front cover 21 to the closed position. The regulating member control unit 400 also allows the torsion spring 300 to be in the unlock state in response to the movement of the front cover 21 to the open position. Compared with a configuration in which switching of the torsion spring 300 between the lock state and the unlock state is independently of the opening and closing movement of the front cover 21, operability can be improved.

The torsion spring 300 is provided at a side the same as a side at which the photosensitive drum drive gear 110 is provided in the axial direction of the shaft 51A of the photosensitive drum 51. Compared with a configuration in which the torsion spring 300 is provided at a side opposite to a side at which the photosensitive drum drive gear 110 is provided in the axial direction of the photosensitive drum 51, displacement of the photosensitive drum 51 can be reliably prevented when the photosensitive drum drive gear 110 is driven in the reverse rotation.

The rotary motion of the rotation member 410 allows the output coupling 200 to protrude toward and retract from the process cartridge 5. The rotation member 410 is employed as a part of the regulating member control unit 400. Accordingly, a configuration of the laser printer 1 can be simplified. Incidentally, a member to protrude and retract the output coupling 200 in association with rotation of the rotation member 410 has been employed in a conventional image forming apparatus. Employment of such a member eliminates an additional new member constituting at least a part of the regulating member control unit 400.

In general, the output coupling 200 (coupling member) and the rotation member 410 are provided at positions adjacent to the shaft 51A of the photosensitive drum 51. Employment of the rotation member 410 as a part of regulating member control unit 400 can realize downsizing of the regulating member control unit 400. As a result, the laser printer 1 can be downsized.

The rotation member 410 has the cam portion 413 disposed at the outer circumferential surface thereof. The pressure transmission member 430 is pressed by the cam portion 413, thereby maintaining the torsion spring 300 in the lock state. Pressure of the cam portion 413 against the pressure transmission member 430 is released, thereby allowing the torsion spring 300 in the unlock state. With this simple configuration, rotation movement of the rotation member 410 can be employed to switch the torsion spring 300 between the lock state and the unlock state.

Further, the cam portion 413 presses the torsion spring 300 via the pressure transmission member 430. Compared with a configuration in which the cam portion 413 directly presses the torsion spring 300, a configuration in which the torsion spring 300 is reliably pressed can be realized. More specifically, for example, in the above described embodiment, as shown in FIG. 5A, the arm 432 of the pressure transmission member 430 is formed in a U-shape as viewed in the front-to-rear direction. The arm 432 is brought into contact with the torsion spring 300 so that a bottom portion of the U-shape is oriented perpendicular to the torsion spring 300 (the front arm 330). With this configuration, the torsion spring 300 can be reliably pressed.

According to the invention as described above, in the configuration of the laser printer 1 capable of forming an image in both surfaces of the sheet S, a gear mechanism (the gear mechanism 100) is attained such that the photosensitive drum drive gear 110 can be driven in the forward rotation when the discharge roller 73 is driven in the forward rotation, and the photosensitive drum drive gear 110 can be driven in the reverse rotation when the discharge roller 73 is driven in the backward rotation.

In this configuration, when the discharge roller 73 is driven in the reverse rotation, the photosensitive drum drive gear 110 is also driven in the reverse rotation. Compared with a configuration disclosed in Japanese laid open publication No. 2005-17914 in which a motor is driven in a reverse rotation upon occurrence of paper jam, the photosensitive drum drive gear 110 is driven in the reverse rotation for a longer period of time. For this reason, the photosensitive drum 51 tends to be displaced (moved). However, displacement of the photosensitive drum 51 can be prevented by the torsion spring 300 in the lock state.

Further, compared with a case when adopting a gear mechanism in which the photosensitive drum drive gear 110 stops when the discharge roller 73 is driven in the reverse rotation or when adopting a gear mechanism in which the photosensitive drum drive gear 110 is driven in the forward rotation even if the discharge roller 73 is driven in the reverse rotation, simplification of the gear mechanism 100 and reduction of cost can be achieved with this configuration. Further, with this configuration, a plurality of the motors M is not necessary. Therefore, downsizing of the laser printer 1, simplified structure of the laser printer 1, and reduction of cost for manufacturing the laser printer 1 can be attained.

While the present invention has been described in detail with reference to the embodiment thereof, it would be apparent to those skilled in the art that various changes and modifications may be made therein without departing from the spirit of the invention.

In the above embodiment, the torsion spring 300 is provided at a side in the left-to-right direction the same as a side where the photosensitive drum drive gear 110 is provided, that is, at the left frame 20L. However, the torsion spring 300 can be provided at a side in the left-to-right direction opposite to a side where the photosensitive drum drive gear 110 is provided, that is, at the right frame 20R. Further, the torsion spring 300 (and the regulating member control unit 400) can be provided at both the left frame 20L and the right frame 20R.

In the present embodiment, the torsion spring 300 is employed as the regulating member. However, a generally V-shaped regulating member formed of resin can be employed instead of the torsion spring 300. Alternatively, a non-resilient regulating plate formed in a generally triangle shape can be employed. In other words, the configuration of the regulating member is not limited to a specific configuration, and can be modified. The torsion spring 300 as the regulating member can urge the shaft 51A of the photosensitive drum 51 toward the rear end of the guide groove 23L in the lock state, thereby accurately positioning the photosensitive drum 51 (the shaft 51A) with respect to the main casing 2.

In the present embodiment, the regulating member control unit 400 allows the torsion spring 300 (regulating member) to be in the lock state, when the front cover 21 (cover) is at the closed position. The regulating member control unit 400 allows the torsion spring 300 to be in the unlock state, when the front cover 21 is at the open position. However, for example, an operating lever can be provided separately from the cover 21. With such an operation lever, the regulating member control unit can switch the between the lock state and the unlock state.

In the present embodiment, the regulating member control unit 400 includes the rotation member 410, the link member 420, and the pressure transmission member 430. However, for example, the rotation member 410 may have a configuration to directly press the torsion spring 300 (regulating member) without providing the pressure transmission member 430.

In the present embodiment, the regulating member control unit 400 includes mechanical components only. However, the regulating member control unit 400 may include an electrical control device in addition to the mechanical components. For example, when a sensor detects that the cover is at its closed position, or when a user performs a predetermined operation (for example, a user presses an operation button), a control device may control the rotation member 410 to rotate the regulating member (torsion spring 300) to be in the lock state. When the sensor detects that the cover is at its open position, or when the user performs a prescribed operation, the control device may control the rotation member 410 to reversely rotate the regulating member (torsion spring 300) to be in the unlock state.

In the present embodiment, the output coupling 200 is employed as the coupling member. However, the shape and configuration of the coupling member can be appropriately determined.

In the present embodiment, the process cartridge 5 includes the photosensitive drum unit 5A, and the developing unit 5B detachably mounted to the photosensitive drum unit 5A. However, a process cartridge in which the photosensitive drum unit 5A and the developing unit 5B are integral with each other (undetachable) is also available.

In the present embodiment, the photosensitive member is the photosensitive drum 51. However, a photosensitive belt is also available.

In the present embodiment, the front cover 21 provided at the front side of the main casing 2 is employed as the cover. However, the cover may be provided at the rear side of the main casing 2.

In the present embodiment, the image forming apparatus is the laser printer 1. However, a LED printer, a copying machine, and a multi-function peripheral are also available.

In the present embodiment, the sheet S can be an OHP sheet instead of a plain paper and a post card.

What is claimed is:

1. An image forming apparatus comprising:

a main body;

process cartridge that is detachably mounted on the main body in a mounting/removing direction and rotatably supports a photosensitive body about a rotational axis;

a positioning guide that is configured to guide the rotational axis of the photosensitive body when the process cartridge is mounted on the main body, and to determine a position of the rotation axis of the photosensitive body with respect to the main body in a mounting state in which the process cartridge has been mounted on the main body;

a photosensitive body drive gear that is configured to be capable of rotating in a forward and reverse direction and to transmit a rotational drive force to the photosensitive body in the mounting state; and a regulating member that is configured to be in a lock state and an unlock state, in the lock state the regulating member prohibiting the rotational axis of the photosensitive body from moving in the mounting/removing direction, the rotational axis of the photosensitive body being released from the regulating member in the unlock state;

a cover that opens and closes an opening formed in the main body, the opening allowing the process cartridge to be mounted on or removed from the main body; and a regulating member control unit that allows the regulating member to be in the lock state when the cover is closed and to be in the unlock state when the cover is opened, wherein the regulating member is provided at a side the same as a side at which the photosensitive body drive gear is provided in an axial direction of the photosensitive body, wherein the process cartridge includes a developing roller supplying a developer to the photosensitive body to form a developer image, the developing roller defining an axial direction; and further comprising a coupling member that is provided on the main body and positioned at a side the same as a side at which the regulating member is provided in the axial direction of the photosensitive body, the coupling member being configured to be capable of protruding toward the developing roller from the main body to transmit the rotational driving force to the developing roller and retracting from the developing roller; and a rotation member that is configured to rotate to allow the coupling member to protrude toward and retract from the developing roller in the axial direction of the developing roller, the rotation member constructing at least a part of the regulating member control unit, the rotation member being configured such that a rotary motion of the rotation member allows the regulating member to be in the lock state and the unlock state, wherein the rotation member has an outer circumferential surface and includes a cam portion radially outwardly protruding from the outer circumferential surface, and wherein the regulating member control unit includes a pressure transmission member constructing a part of the regulating member control unit, the cam portion being configured to press the pressure transmission member when the rotary motion of the rotation member allows the coupling member to protrude toward the developing roller and configured to release a pressure of the cam portion against the pressure transmission member when the rotary motion of the rotation member allows the coupling member to retract from the developing roller, the pressure transmission member being configured to press the regulating member to be in the lock state when the cam portion presses the pressure transmission member and configured to release a pressure of the pressure transmission member against the regulating member to allow the regulating member to be in the unlock state when the pressure of the cam portion against the pressure transmission is released.

2. The image forming apparatus according to claim 1, wherein the regulating member is a torsion spring.

3. The image forming apparatus according to claim 2, wherein the regulating member control unit includes a link member constructing a part of the regulating member control unit, the link member being configured to rotate the rotation member in association with an opening and closing movement of the cover, and wherein the cam portion has a first pressing surface and a second pressing surface continuously extending from the first pressing surface, the first pressing surface being configured to press and displace the pressure transmission member as the cover is moved to close the opening formed in the main body, the second pressing surface having a cylindrical surface arranged concentrically with the rotation member.

4. The image forming apparatus according to claim 3, wherein the cam portion has a third pressing surface continuously extending from the second pressing surface, the third pressing surface having a distance from a rotational axis of the rotation member smaller than that of the second pressing surface.

5. The image forming apparatus according to claim 1, further comprising a discharge roller that is configured to be capable of rotating forward and in reverse, the discharge roller rotating forward when a recording sheet is discharged externally from the main body, the recording sheet having a front surface and a rear surface, the discharge roller rotating in reverse to draw back the recording sheet into the main body when one image is formed on the rear surface after another image has been formed on the front surface; and a drive source that supplies a rotational driving force to the discharge roller and the photosensitive drum drive gear, and wherein the photosensitive drum drive gear is configured to rotate in the forward direction when the discharge roller rotates forward and to rotate in the reverse direction when the discharge roller rotates in reverse, the photosensitive drum rotating in a direction opposite to a direction in which the photosensitive drum rotates to form a developer image thereon when the photosensitive drum drive gear rotates in the reverse direction.

6. An image forming apparatus comprising:

a main body;

a process cartridge that is detachably mounted on the main body in a mounting/removing direction and rotatably supports a photosensitive body about a rotational axis;

a photosensitive body drive gear that is configured to be capable of rotating in a forward and reverse direction and to transmit a rotational drive force to the photosensitive body in a mounting state in which the process cartridge has been mounted on the main body;

a regulating member that is configured to be in a lock state and an unlock state, in the lock state the regulating member prohibiting the rotational axis of the photosensitive body from moving in the mounting/removing direction, the rotational axis of the photosensitive body being released from the regulating member in the unlock state;

a cover that opens and closes an opening formed in the main body, the opening allowing the process cartridge to be mounted on or removed from the main body; and a regulating member control unit that allows the regulating member to be in the lock state when the cover is closed and to be in the unlock state when the cover is opened, wherein the regulating member is provided at a side the same as a side at which the photosensitive body drive gear is provided in an axial direction of the photosensitive body, wherein the process cartridge includes a developing roller supplying a developer to the photosensitive body to form a developer image, the developing roller defining an axial direction, further comprising a coupling member that is provided on the main body and positioned at a side the same as a side at which the regulating member is provided in the axial direction of the photosensitive body, the coupling member being configured to be capable of protruding toward the developing roller from the main body to transmit the rotational driving force to the developing roller and retracting from the developing roller; and a rotation member that is configured to rotate to allow the coupling member to protrude toward and retract from the developing roller in the axial direction of the developing roller, the rotation member constructing at least a part of the regulating member control unit, the rotation member being configured such that a rotary motion of the rotation member allows the regulating member to be in the lock state and the unlock state, wherein the rotation member has an outer circumferential surface and includes a cam portion radially outwardly protruding from the outer circumferential surface, and wherein the regulating member control unit includes a pressure transmission member constructing a part of the regulating member control unit, the cam portion being configured to press the pressure transmission member when the rotary motion of the rotation member allows the coupling member to protrude toward the developing roller and configured to release a pressure of the cam portion against the pressure transmission member when the rotary motion of the rotation member allows the coupling member to retract from the developing roller, the pressure transmission member being configured to press the regulating member to be in the lock state when the cam portion presses the pressure transmission member and configured to release a pressure of the pressure transmission member against the regulating member to allow the regulating member to be in the unlock state when the pressure of the cam portion against the pressure transmission is released.

* * * * *